United States Patent [19]

Paig

[11] 4,142,391

[45] Mar. 6, 1979

[54] RE-KEYING LOCKING KIT AND METHOD THEREOF

[76] Inventor: Robert M. Paig, 9282 Nautilus Dr., Huntington Beach, Calif. 92646

[21] Appl. No.: 715,632

[22] Filed: Aug. 18, 1976

[51] Int. Cl.[2] ..... E05B 63/00

[52] U.S. Cl. ..... 70/461

[58] Field of Search ..... 70/461, 460, 409, 378, 70/371

[56] References Cited

U.S. PATENT DOCUMENTS

| | | | |
|---|---|---|---|
| 2,070,228 | 2/1937 | Fity Gerald | 70/460 X |
| 2,268,511 | 12/1941 | Ledin | 70/371 |
| 3,422,643 | 1/1969 | Foote | 70/371 |

*Primary Examiner*—Richard E. Moore

[57] ABSTRACT

A re-keying lock kit and a method thereof providing a simple means for changing master keys to match replaceable key pins in either entrance or dead-bolt locking units. The kit comprises a plurality of color-coded key pins and at least one pre-cut key, wherein the color-coded pins are pre-selected to match the key cuts of the particular supplied key of the kit. Included within the kit is a cylinder-removal tool, a cylinder follower, and an instruction sheet indicating the steps by which the re-keying is accomplished.

1 Claim, 9 Drawing Figures

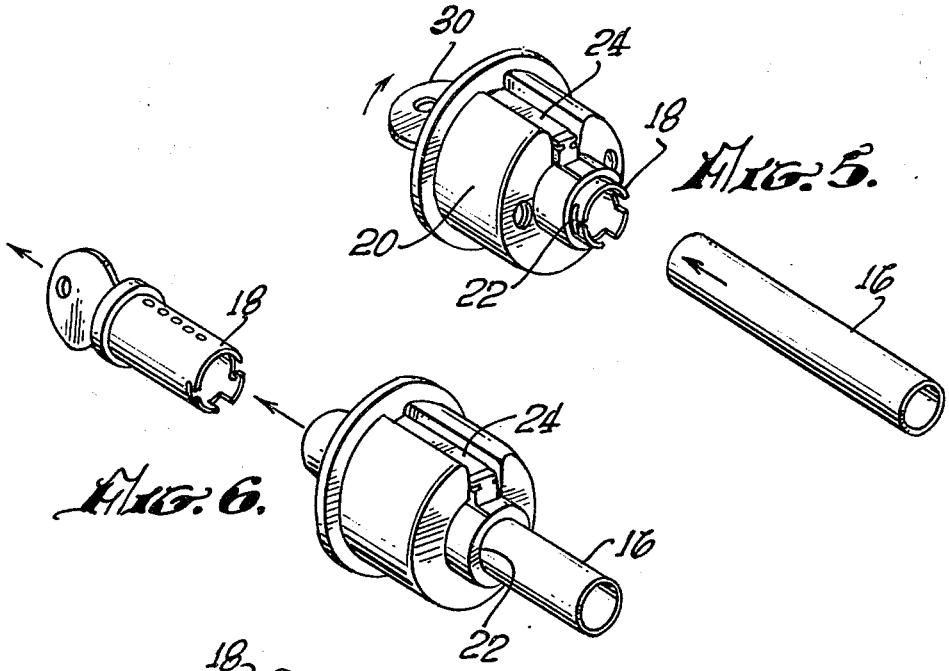
FIG. 5.
FIG. 6.
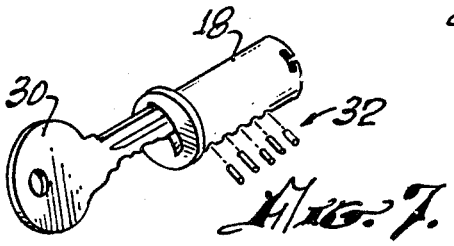
FIG. 7.
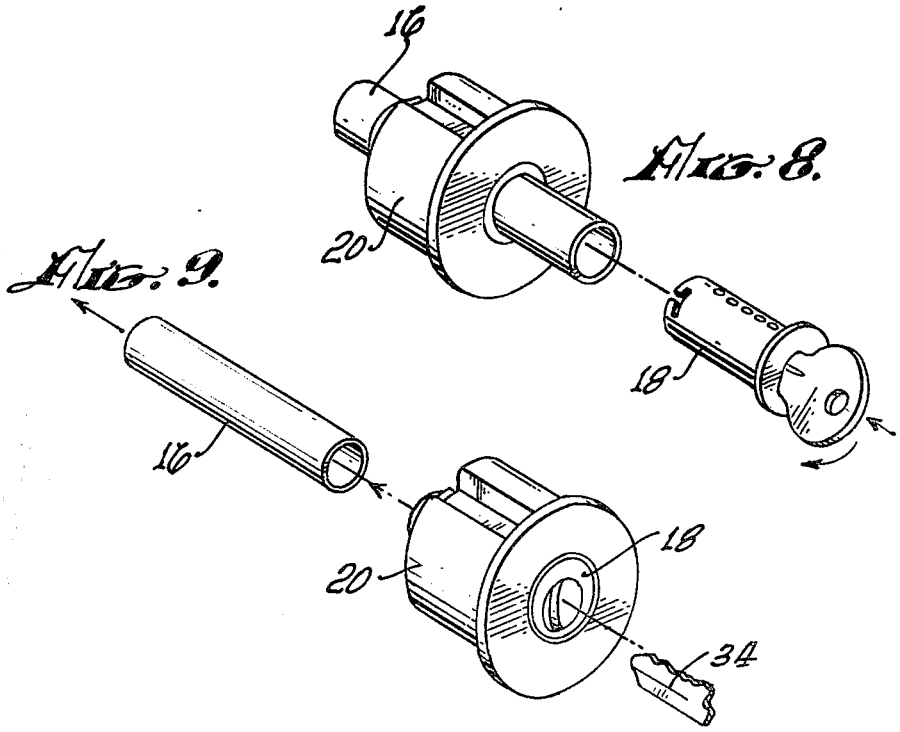
FIG. 8.
FIG. 9.

RE-KEYING LOCKING KIT AND METHOD THEREOF

BACKGROUND OF THE INVENTION

1. Field of the Invention

This invention relates generally to key operated locks, and more particularly to elements and a method of re-keying locks for use with a new original key.

2. Description of the Prior Art

As is well known in the art, various problems and difficulties are encountered in providing suitable means for individual, other than professional locksmiths, to change existing locks of any kind, whereby the lock can be operated by a new set of keys.

At the present time, there are no provisions available that will allow the average homeowner or laymen to change their own locks and keys. That is, whenever one wants to change locks, which is often done with rental properties, a locksmith must be called to perform the change. This is also generally the case when a homeowner or laymen wishes to change all the locks in his home, particularly, when he wants all the locks to operate with the same key. This becomes very expensive and time consuming.

SUMMARY OF THE INVENTION

The present invention comprises a re-keying lock kit and a method for re-keying an established locking unit. The elements and tools supplied in the kit are combined as a "do-it-yourself" package wherein certain types of locking units can be disassembled. At this time, preselected color-coded pins are used according to a preselected key having key cuts arranged to accept the matching pins when positioned within the key pin cylinder plug.

Accordingly, one will remove the main key cylinder housing from a particular lock unit, whether it be a dead-bolt lock or an entrance lock of any make. Each particular kit will include tools for a particular key lock unit manufactured by a given manufacturer. With these tools, the main key cylinder housing is removed from the unit and the key pin cylinder plug is freed from the housing. At this point, the cylinder plug housing the key pins is removed by the cylinder follower which is forced against the cylinder plug. However, the key of the lock must be inserted in the pin cylinder plug and rotated at least 10° left or right to prevent the spring-loaded driver pins from becoming disassembled. As the follower is inserted therein, the key plug is forced from the main housing, at the same time keeping the driver pins in place. The old key is then removed and the old pins are allowed to drop out of the pin plug.

The new, key is inserted into the cylinder plug and the color-coded pins are arranged within the plug according to the specific diagram relating to the cut of the new key. Then the reverse steps are taken to assemble the lock unit.

OBJECTS AND ADVANTAGES OF THE INVENTION

The present invention has for an important object to provide a "do-it-yourself" re-keying kit that will enable anyone to easily and simply change a lock to accommodate a new original key.

It is another object of the invention to provide a re-keying kit that includes a key having pre-selected key cuts to match a pre-selected color-coded group of corresponding pins.

It is still another object of the present invention to provide a re-keying kit that will include special tools to disassemble the key unit of a particular manufacture.

It is a further object of the present invention to provide a lock kit of this character that includes a very simple method of disassembling and reassembling a given lock unit with a completely different arrangement of key pins.

It is still a further object of the invention to provide a re-keying kit that is relatively inexpensive to manufacture.

The characteristics and advantages of the invention are further sufficiently referred to in connection with the accompanying drawings, which represent one embodiment. After considering this example, skilled persons will understand that variations may be made without departing from the principles disclosed and I contemplate the employment of any structures, arrangements or modes of operation that are properly within the scope of the appended claims.

BRIEF DESCRIPTION OF THE DRAWINGS

Referring more particularly to the accompanying drawings, which are for illustrative purposes only:

FIGS. 5 through 9 illustrates the various steps that must be taken to complete the changing of the key pins, allowing a new original key to be used therewith.

DESCRIPTION OF THE PREFERRED EMBODIMENT

Figure 1:
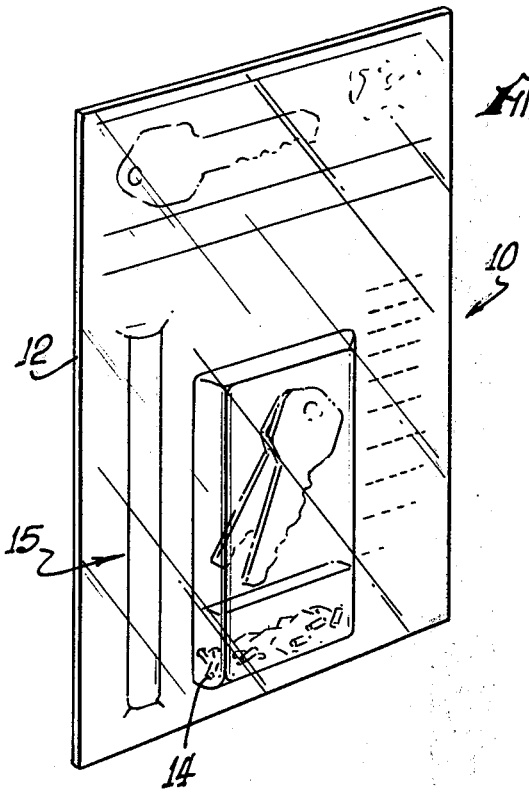
FIG. 1 is a perspective view of the present invention illustrated as being packaged with all the necessary components and instructions included therein.

Referring more particularly to FIG. 1, there is shown a completed "do-it-yourself" kit, generally indicated at 10. It is contemplated that kit 10 will be packaged in the manner shown, having a support backing 12 and transparent plastic cover 14. However, other suitable packaging means can be employed as well.

Included within the package kit 10 are necessary operating tools, indicated generally at 15. These tools will include whatever special tools are needed for a particular manufactured lock unit.

Since there are several lock manufacturers, each having his own designed locks, there must be included a tool or tools necessary to disassemble the lock unit to a point wherein the universal components can be separated by tools common to all locks.

Accordingly, the common tools and components include a cylinder follower 16, which allows the cylinder pin plug 18 to be removed from the main cylinder lock 20 housing.

The main cylinder lock housing is well understood in the art and is herein illustrated to comprise a central bore 22 in which cylinder pin plug 18 is operably positioned. Also, generally found in the main housing are the drive pins which are spring loaded.

Since the drive pins are well known and are not part of the present invention, they are not shown but are located in pin jacket 24.

Thus, to make the proper changes whereby a new key can be used to operate the lock, one buys a kit as described, the kit being one that is arranged to match the particular manufactured lock unit.

For the purpose of ease in understanding, the overall steps the following lock will be described as being of the deadbolt type.

Figure 4:
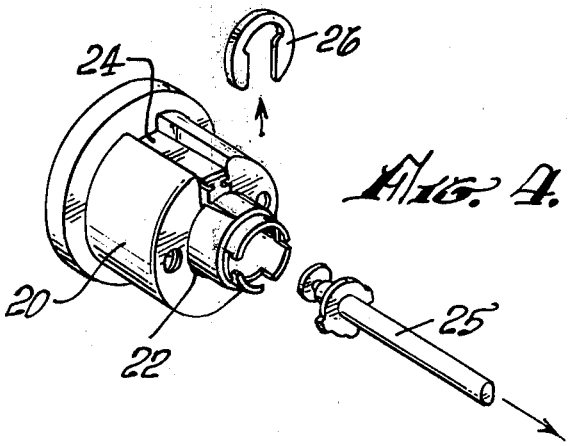
FIG. 4 is a view illustrating the first step of removing the pin plug.

Once the main key housing 20 is removed from the unit (See FIG. 4), the torque shaft 25 is removed along with retaining clip 26, wherein the cylinder pin plug 18 is freed for removal. In order to remove plug 18, the old key 30 (FIG. 5) is inserted into plug 18 and rotated either to the right or left approximately 10°.

This rotation of the cylinder plug 18 prevents the spring-loaded drive pins from dropping free when said plug 18 is removed. After rotating plug 18, the cylinder follower 16 is positioned against the back of cylinder plug 18, forcing said plug from bore 22, as seen in FIG. 6. During this step, the follower 16 holds the drive pins in pin jacket 24 from dropping out.

Figure 2:
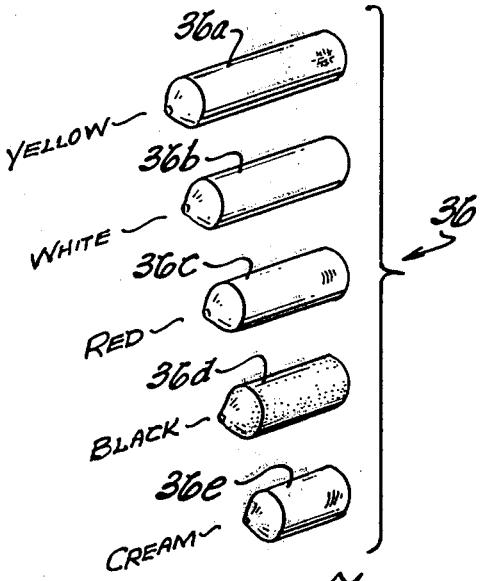
FIG. 2 is a perspective view of a plurality of various sized and color-coded key pins.
Figure 3:
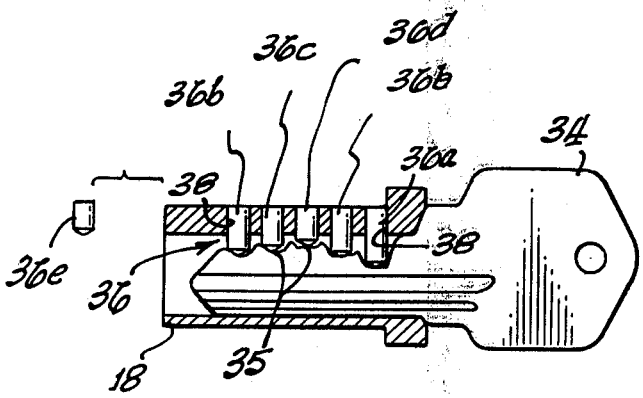
FIG. 3 is a schematic cross-sectional illustration of a pin cylinder plug having the coded pins aligned to be received in a pre-selectively cut key provided within the kit assembly.

As seen in FIG. 7, the original pins, generally indicated at 32, are removed from plug 18 along with the old key 30. The new key 34 taken from the kit is then inserted in plug 18, as illustrated in FIG. 3. This key includes pre-selected key cuts 35. That is, key cuts 35 are arranged to match the color-coded pin, designated generally at 36 (See FIGS. 2 and 3).

The kit includes at least five pins, each having a specific color indicated on its surface. As an example, pin 36*a* is indicated as yellow; 36*b* as white; 36*c* as red; 36*d* as black; and 36*e* as cream.

Accordingly, means for instructions will be provided either on a separate sheet or on the backing 12, along with a diagram similar to FIG. 3, wherein the pins are shown in their proper holes 38 to align with respective matching key cuts 35.

Thus, it can be seen in FIG. 3 that various combinations can be simply arranged for any given kit.

In the arrangement shown in FIG. 3, there is illustrated how two of the same color pins (white) 36*b* have the same size and are used to match the selected cuts of the new key 34. It then becomes very simple for any individual to arrange the pins without difficulty.

Once, the new pins 36 are in their proper order and in hole 38 within plug 18, said plug is inserted at a 10° offset, forcing follower 16 out of bore 22 of the main key housing 20. This is shown in FIGS. 8 and 9. The plug can then be turned to a normal position whereby key 34 can be removed.

Plug 18 is held in place and retaining clip 26 is replaced along with torque shaft 25. At this point, the housing 20 is replaced in its particular body, once again forming a complete locking unit having new pins and a matching key.

It is contemplated that each kit will contain at least two complete pre-selected sets of pins and two matched cut keys.

The invention and its attendant advantages will be understood from the foregoing description and it will be apparent that various changes may be made in the form, construction and arrangement of the parts of the invention without departing from the spirit and scope thereof or sacrificing its material advantages, the arrangement herein before described being merely by way of example, and I do not wish to be restricted to the specific form shown or uses mentioned, except as defined in the accompanying claims.

I claim:

1. A re-keying lock kit, for use with existing lock units that contain a removable cylinder pin plug, wherein the existing key has key cuts which are in cooperative relationship with the key pins all of which are to be discarded, and wherein the kit comprises in combination:

at least one key having pre-selected key cuts formed therein different from the key cuts on the key to be discarded;

a plurality of pre-selected key pins of various lengths, each particular pin being color coded to correspond with a particular length which cooperatively interacts with a respective pre-selected cut for said key; and a hollow cylinder of the same diameter as the cylinder pin plug which removably pushes the cylinder case out while holding the internal parts in place.

* * * * *